United States Patent [19]

Karr

[11] 4,068,010

[45] Jan. 10, 1978

[54] LIQUID CARBON DIOXIDE CARBONATION METHOD

[75] Inventor: Fred A. Karr, Redwood City, Calif.

[73] Assignee: Shasta Beverages, Division of Consolidated Foods Corporation, Hayward, Calif.

[21] Appl. No.: 719,735

[22] Filed: Sept. 2, 1976

Related U.S. Application Data

[62] Division of Ser. No. 643,096, Dec. 22, 1975, Pat. No. 4,022,119.

[51] Int. Cl.[2] ..... C02D 1/02

[52] U.S. Cl. ..... 426/477; 62/1; 99/323.2; 261/DIG. 7; 426/524

[58] Field of Search ..... 426/477, 67, 524; 62/1, 62/46, 307, 52; 99/275, 276, 277.1, 323.1, 323.2; 261/36 R, 159, 160, DIG. 7; 222/146 C, 399; 165/2, 141, 155, 160

[56] References Cited

U.S. PATENT DOCUMENTS

| | | | |
|---|---|---|---|
| 524,888 | 8/1894 | Craney | 261/DIG. 7 |
| 575,932 | 1/1897 | Nageldinger | 222/399 |
| 955,182 | 4/1910 | Michal | 261/DIG. 7 |
| 998,428 | 7/1911 | Stuhler | 261/DIG. 7 |
| 1,628,853 | 5/1927 | Lomax | 222/146 C |
| 1,651,612 | 12/1927 | McDonald et al. | 222/146 C X |
| 2,699,718 | 1/1955 | Wright | 99/275 |
| 2,855,307 | 10/1958 | Konig | 426/477 |
| 3,479,839 | 11/1969 | Scott | 165/155 X |
| 3,832,474 | 8/1974 | Karr | 426/477 |

OTHER PUBLICATIONS

Perry; "Perry's Chem. Engineer's Handbook", 4th Ed., 1963; McGraw-Hill Chem. Engineering Series; pp. 22-106.

*Primary Examiner*—Robert L. Lindsay, Jr.
*Assistant Examiner*—Kenneth M. Schor
*Attorney, Agent, or Firm*—Flehr, Hohbach, Test, Albritton & Herbert

[57] ABSTRACT

A method for simultaneously carbonating and cooling a liquid beverage. The apparatus used for the method includes an upright enclosed vessel with an upright coaxial carbonating column within the same and spaced therefrom to define an upright channel. A source of liquid to be carbonated and liquid carbon dioxide are directed into the lower end of the carbonating column and the product overflows the carbonating column into the annular channel wherein it passes downwardly and out of the vessel. A bypass line of ambient liquid is sprayed onto the top of the carbonating column to dissolve floating ice crystals. Also, a screen is placed between the carbonating column and annular channel to prevent passage of such ice crystals.

7 Claims, 1 Drawing Figure

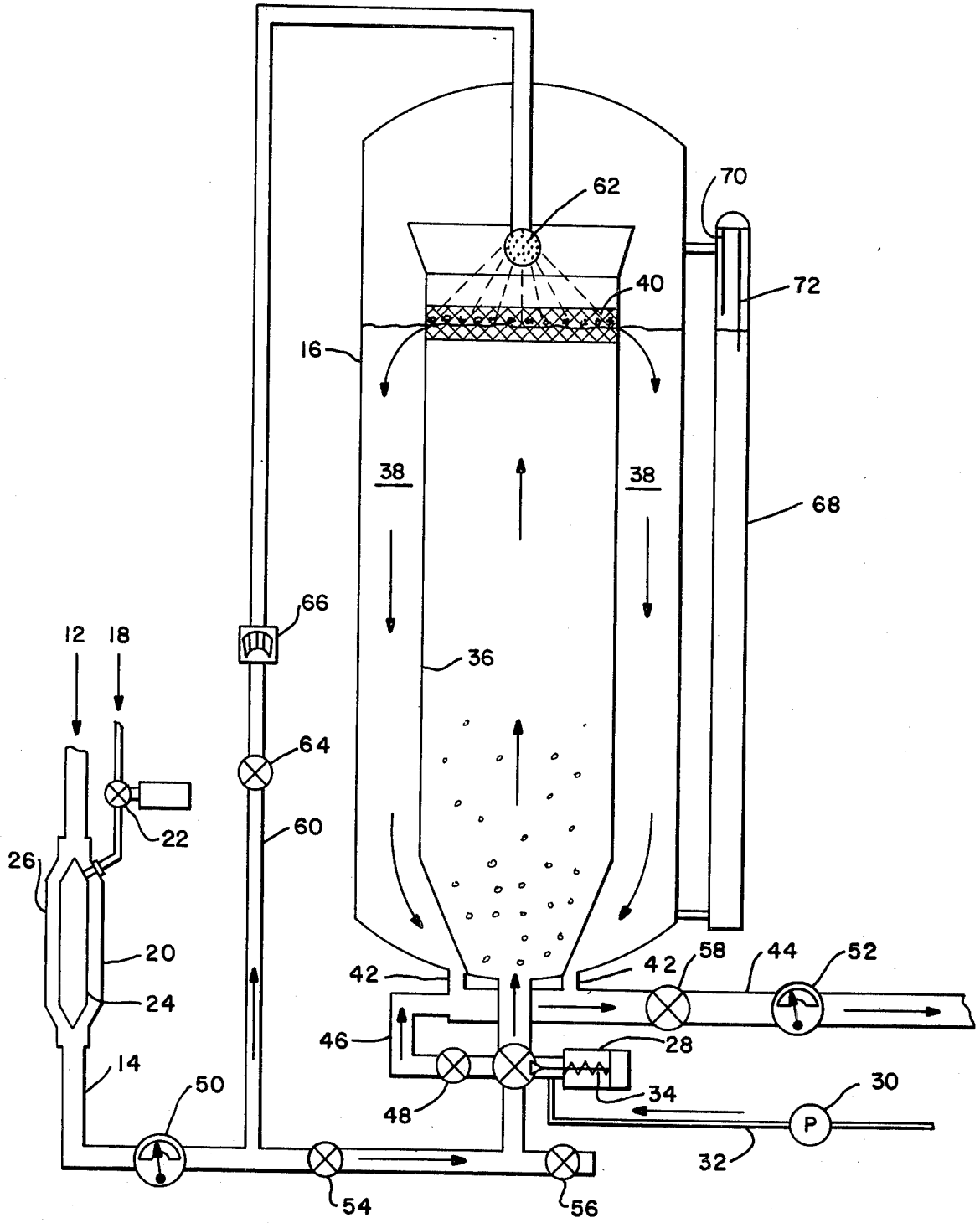
62
70
40
72
16
38
38
68
66
12
18
36
64
22
60
26
20
42
42
58
44
52
24
46
28
14
50
48
34
30
P
32
54
56

LIQUID CARBON DIOXIDE CARBONATION METHOD

This is a division, of application Ser. No. 643,096 filed Dec. 22, 1975 now U.S. Pat. No. 4,022,119.

BACKGROUND OF THE INVENTION

The present invention relates to a system for carbonating and cooling liquid for the production of beverages such as soft drinks. In conventional carbonating systems, gaseous carbon dioxide is directed into the top of a carbonator cooling tank which includes refrigerated cooling plates. The product enters the top of the tank and flows downwardly over the cooling plates. If liquid carbon dioxide is directed into a conventional carbonator cooler of the foregoing type, excessive ice crystals would form and freeze to the product line internal surfaces. One reason for such freezing is the excessive refrigeration generated from injection pressure without provision for effective heat exchanger of the same.

The use of liquid carbon dioxide for carbonation of liquids provides the major advantage of cooling the liquid simultaneously with carbonation. It is well known that the reduction of temperature renders the carbonated liquids susceptible to increased amounts of carbon dioxide to form a stable product. Once stabilized, the product tends to retain the carbon dioxide even at increased temperatures. One system for carbonating liquid which employs an auxiliary liquid carbon dioxide injection is set forth in my U.S. Pat. No. 3,832,474. There, carbon dioxide is injected from a liquid carbon dioxide valve from a high pressure metering pump into a line connected to the bottom of a stabilizing tank. Liquid carbon dioxide expands into a gaseous state and simultaneously produces a refrigeration or cooling effect. In the above system, carbonated liquid is withdrawn in a stream from the bottom of the tank.

If the above system were employed in a highly carbonated product with the total carbon dioxide being supplied in liquid form, ice crystals would tend to form in the product and float to the top of the liquid in the tank. Since there is no disclosure of a technique for melting such crystals, they could accumulate and form a layer of sufficient depth to disrupt the uniformity of carbonation. Another disadvantage of the system is that it does not optimize the massive refrigeration generated at the point of introduction of the carbon dioxide into the stabilizing tank. The excess refrigeration at this point could be employed more effectively for energy conservation.

SUMMARY OF THE INVENTION AND OBJECTS

In accordance with the present invention, a method and apparatus is provided for simultaneously carbonating and cooling a liquid, such as a carbonated beverage. The carbon dioxide is injected in liquid form into the bottom of a carbonating column of liquid. The liquids flows upwardly through the column and then over the top into an annular channel around the same for withdrawal from the vessel. Thus, the liquid flowing in the outer channel is cooled by conductive heat exchange with the coolest area of the vessel, i.e., the lowermost area of the carbonating column.

The cooling effect of liquid carbon dioxide carbonation is so great that ice crystals may tend to form in the area of injection which can float to the top of the liquid in the carbonation column and accumulate there. If these crystals are permitted to pass into the line, they can cause clogging and freeze-up. To avoid this, a bypass line of ambient liquid to be carbonated is sprayed upon the upper surface of the carbonated liquid to melt the ice crystals and mix with the product. In addition, a screen is provided for the liquid cverflowing into the annular channel to retain accumulating ice crystals.

The flow rate of the carbonated liquid down through the annular chamber is adjusted to provide a sufficient residence time to stabilize the carbon dioxide bubbles in the flowing liquid. This avoids the use of a separate stabilizing tank in the system.

It is an object of the invention to provide an efficient, energy conservative system for simultaneously carbonating and cooling of a liquid such as used in carbonated soft drinks, beer or the like.

It is another object of the invention to provide a system of the foregoing type in which the refrigeration effect of carbonation by liquid carbon dioxide is efficiently utilized.

It is a further object of the invention to provide a system of the foregoing type in which carbonation, cooling and stabilizing of carbonation can be accomplished in a single vessel.

It is an additional object of the invention to provide a system of the foregoing type which overcomes the problems of freeze-up in a system using liquid carbon dioxide.

Further objects and features of the invention will be apparent from the following description taken in conjunction with the accompanying drawing.

BRIEF DESCRIPTION OF THE DRAWING

The drawing is a schematic diagram of one embodiment of the present invention.

DETAILED DESCRIPTION OF THE PREFERRED EMBODIMENTS

Referring to the drawing, a system in accordance with one embodiment of the invention is illustrated wherein a source 12 of warm liquid to be carbonated is connected through an ambient product inlet line 14 to the bottom of a cooling and carbonation vessel 16. Gaseous carbon dioxide from a pressurized source 18 is directed into a carbon dioxide injection assembly 20 through a suitable two-way valve 22.

Gaseous carbon dioxide may be introduced into gaseous carbon dioxide injection assembly 20 suitably of the type described in my U.S. Pat. No. 3,256,802, incorporated herein by reference. Assembly 20 comprises a liquid-tight inner housing 24 with an enlarged outer housing 26. Housing 24 includes a cylindrical tube with conical front and rear ends formed of a porous or sintered material with sufficient porosity (e.g., about 2–5 microns openings) to permit the passage of carbon dioxide bubbles of a desired size without requiring undue pressure from carbon dioxide source 18. The gas is emitted into the ambient temperature liquid under high pressure.

The present invention relates to the use of liquid carbon dioxide for simultaneously cooling and carbonating a liquid. Gaseous carbon dioxide injection assembly 20 is optionally employed when liquid carbon dioxide injection is in excess of the total cooling requirements for carbonation. Thus, if a highly carbonated product were injected with liquid carbon dioxide only, the final product temperature may be below that required to stabilize the product at this temperature. In this instance, gaseous carbon dioxide injection, as from assembly 20, may be employed to conserve the energy requirements of the system and to prevent freeze-up in the same.

The primary source of carbonation and cooling is supplied from a liquid carbon dioxide injection valve 28 connected to a suitable source of liquid carbon dioxide in high pressure supply line 32 connected to a conventional precision high pressure metering pump 30. As illustrated, valve 28 projects from line 14 in a T-shaped configuration and includes a heavy spring loaded plunger 34 terminating with a valve seat plug which blocks carbon dioxide flow into line 14 until carbon dioxide in line 32 reaches a predetermined carbonating pressure. The spring is set for release at pressures between 300 and 2,000 psi, typically about 1,000 psi.

In a typical instance, liquid carbon dioxide is maintained in a storage tank at approximately 0° F with a head pressure of about 300 psi. The liquid carbon dioxide raises the valve seat of plunger 34 in response to a pressure developed by metering pump 30 and is injected into the low pressure liquid wherein it crystallizes into fine particles of dry ice. These particles instantaneously expand or explode into a gaseous state into the liquid flowing through line 14 forming fine bubbles of a size comparable to gaseous injection from assembly 20. The bubbles rapidly collapse into solution as the liquid travels upwardly in carbonating column 36, described hereinafter. The refrigeration or cooling effect generated by the liquid carbon dioxide expanding into the product liquid may be increased or decreased by correspondingly varying the injection pressure. The lowering of temperature renders the carbonated products susceptible to increased amounts of carbon dioxide. As is well recognized, the pressure required to stabilize the carbonated product is reduced with lower temperatures.

After injection with carbon dioxide at valve 28, the stream in line 14 flows upwardly into the lower portion of vessel 16 through upright carbonating column 36. Column 36 is of circular cross-sectional area and of generally cylindrical shape with a frustoconical shape at its lowermost portion. It includes a wall of heat conductive material, preferably metal. The upper portion of column 36 includes a lip of slightly increased diameter in an upward direction to retain liquid spraying into the column. Vessel 16 and carbonating column 36 are coaxial and of generally cylindrical shape to define an annular channel 38 therebetween.

A cylindrical screened outlet opening 40 is provided in the upper portion of column 36 to provide a uniform outlet for liquid flowing upwardly through column 36 and thereafter downwardly into channel 38. Dual outlet lines 42 interconnect the carbonated product from channel 38 and the carbonated liquid product line 44. A by-pass line 46 is provided in line 14 together with a suitable valve 48 to permit draining of beverage from carbonating column 36 into the product line 44, such as at the end of a run or during the cleaning and sterilizing process.

Referring to inlet line 14 and product line 44, suitable temperature sensing devices, thermometers 50 and 52, provide means for measuring the inlet and outlet temperature of the product. Also, a throttle valve 54 and a drain valve 56 are provided for line 14 while a shut-off valve 58 for the entire system is provided in product line 44.

An ambient liquid bypass line 60 is provided in line 14 terminating at its free end with liquid distribution means comprising revolving distribution spray ball 62. Ball 62 is proximal to the interior of the upper portion of column 36 preferably just above liquid outlet 40. Bypass line 60 includes a suitable two-way valve 64 and a flowmeter 66. The purpose of bypass line 60 is to provide ambient product for spraying from spray ball 62 to melt any floating ice crystals on top of the liquid in column 36 and to uniformly intermix with the cooler product therein.

Vessel 16 is provided with a level control electrode assembly 68 which includes upper and lower electrode pairs 70 and 72, respectively, serving the liquid level between the lower ends of pairs 70 and 72.

Operation of the above system is as follows: Liquid to be carbonated, typically ambient pre-mix (flavored syrup and water) is directed in line 14 pass auxiliary gaseous carbon dioxide injection assembly 20 to carbonating column 36. The flow rate of ambient pre-mix beverage from conventional pre-mix proportioning unit (not shown) is preset to be slightly higher than the flow rate from vessel 16 to the bottle or can filling operation.

If the liquid level rises in level control electrode assembly 68 and contacts electrode pair 70, this would actuate stoppage of the pre-mix proportioning pump which pumps the pre-mix beverage to vessel 16 and, simultaneously would actuate stoppage of liquid carbon dioxide metering pump 30. In other words, when liquid level rises in carbonating vessel 16 and contacts high level electrode pair 70, flow rate of pre-mix and liquid carbon dioxide is prevented from entering carbonating vessel 16 while gaseous carbon dioxide valve 22 closes.

If the liquid level in electrode assembly 68 lowers and breaks contact with low level electrode pair 72, this simultaneously starts the pre-mix proportioning pump and liquid carbon dioxide metering pump and opens gaseous carbon dioxide solenoid valve 22. If the refrigeration from injection of liquid carbon dioxide through valve 28 is in excess of the total cooling requirements of the liquid, gaseous carbon dioxide is injected through inner housing 24 into the product to supply part of the carbonation. This conserves the energy required to supply the liquid carbon dioxide and also avoids excess refrigeration near liquid carbon dioxide injection which could freeze-up the system. The ambient liquid flows through open valve 54 and into the lower portion of carbonate column 36. Liquid carbon dioxide is injected through valve 28 at a predetermined pressure. The liquid carbon dioxide expands upwardly into the bottom of column 36 under the preset operating gaseous head pressure. There, a carbon dioxide snow is generated which refrigerates the product. The snow expands into fine carbon dioxide bubbles that are callapsed into solution by the force of the selected operating head pressure of vessel 16. By the time the product flows upwardly to outlet 40 at the upper portion of column 36, complete carbonation is accomplished.

The maximum degree of refrigeration is generated in the area of liquid carbon dioxide injection. Accordingly, to prevent freeze-up in this area, valve 28 is positioned closely adjacent the bottom of carbonating column 36 and, in an embodiment not shown, may even be injected directly into the column. Fine crystals tend to form in the area of maximum refrigeration generated, the lower portion of the column. Since there are no confined pipe lines or distribution pans for the ice crystals to collect upon, as in conventional carbonators, they flow freely to the uppermost portion of column 36 and float in a melting zone adjacent outlet 40. Accumulation of the ice crystals is prevented by spraying with ambient temperature product through spray ball 62. Ambient temperature product flows in bypass line 60 at a rate controlled by valve 64.

Cooled and carbonated product overflow the liquid body tank 36 through screen 40 and continues to float downwardly through annular channel 38. Screen 40 prevents ice crystals from entering channel 38 which might otherwise interfere with uniform carbonation. Cylindrical outlet opening 40 permits uniform blending of ambient temperature product being sprayed from ball 62 with the product at the top of the carbonation tank.

After overflow from column 36, the product flows downwardly through annular channel 38 and is removed in outlet lines 42 connected to product line 44.

An important feature of the present invention is the efficient utilization of liquid carbon dioxide for both carbonation and for part or all of the required refrigeration. A major feature of the system is the flow pattern of the liquid upwardly through column 36 and thereafter downwardly past the same through annular channel 38 prior to exiting from vessel 16. In this manner, the refrigeration generated at a maximum at the lower portion of column 36 is utilized by conductive heat transfer through the wall of column 36 to cool product flowing downwardly past the same.

Another unique feature of the above system is the significantly greater height of the above system in comparison to the diameter. This height is selected so that sufficient residence time is provided in the flow of the liquid upwardly through column 36 and downwardly through channel 38 to accomplish stabilizing of the carbon dioxide bubbles in the liquid. This avoids using separate carbonation and stabilization tanks. Since the carbon dioxide gas and product are confined in column 36, uniform heat exchange and carbonation are achieved by consecutive upward and downward flow of the product.

After carbonation in the foregoing system, the product may be directed to a conventional counterpressure filler for carbonated beverages. In one alternative technique, the product may be first firected to a pressure reduction tank prior to filling as fully described in my U.S. Pat. No. 3,832,474, incorporated at this point by reference.

Depending upon the desired degree of carbonation, the above system can be employed to supply part or all of the refrigeration required for a carbonated product. This eliminates a large amount of maintenance and equipment required for conventional refrigeration. In addition, the degree of refrigeration is equal to that generated by the amount of precision meter liquid carbon dioxide and the preset injection pressure. This eliminates product waste from warm-ups and freeze-ups caused by faulty mechanical refrigeration temperature control instruments or refrigeration compressor malfunction.

A further disclosure of the nature of the present invention is provided by the following specific examples of the practice of the invention. It should be understood that the data disclosed serve only as examples and are not intended to limit the scope of the invention.

EXAMPLE 1

Carbonation of a cold soft drink at 3.5 volumes of carbon dioxide is as follows. A mixture of water and syrup (herein "liquid") is pumped line 14. For sufficient product for 600 cans per minute of 12 ounce cans, the carbonating column 36 is desired to hold an average 150 gallons of product during the filling operation. This provides to the product a total retention time of 12 vessel 16 of 2.5 minutes. It is apparent that the vessel can be sized for any degree of holding time, depending upon the nature of the product to be carbonated and the degree of carbonation. Under the above conditions, liquid carbon dioxide from metering pump 32 is set to deliver approximately 3.3 pounds of liquid carbon dioxide per minute. At a carbon dioxide injection set at 800 psi, the refrigeration generated by the expansion of the liquid carbon dioxide cools the ambient product from 70° F to approximately 40° F. The product may then pass through a heat exchanger for final mechanical cooling, e.g., to 33° F. In the above situation, approximately 80% of the required refrigeration is generated by liquid carbon dioxide injection. In this system, no gaseous carbon dioxide is injected from assembly 20.

EXAMPLE 2

The above process parameters are employed with the exception that the product has a lower carbonation, 2.0 volumes. With the pressure injection from valve 28 set at 1,000 psi, and pump 32 set to deliver approximately 1.9 psi carbon dioxide per minute, the product is cooled from 70° F to 40° F. At the lower carbonation of 2.0 volumes, the product does not require any refrigeration in addition to that generated by liquid carbon dioxide injection.

What is claimed is:

1. In a method for simultaneously carbonating and cooling an aqueous liquid, the steps of a. containing a body of aqueous liquid in an upright carbonating column having a heat conductive wall,
b. supplying aqueous liquid from a stream of aqueous liquid to be carbonated into the bottom region of said carbonating column,
c. injecting liquid carbon dioxide into the bottom region of said carbonating column and thus carbonating and cooling the liquid from said stream,
d. overflowing cooled carbonated liquid from the top region of said carbonating column,
e. passing said overflowing carbonated aqueous liquid downwardly through a channel around said carbonating column extending downwardly to the level of the bottom of said heat conductive wall, to further cool the carbonated aqueous liquid in said channel by heat transfer across said heat conductive wall.

2. The method of claim 1 in which said liquid carbon dioxide is injected into said aqueous liquid stream prior to being supplied into said aqueous liquid body.

3. The method of claim 1 together with the step of f. withdrawing aqueous liquid from said stream of aqueous liquid to be carbonated, directing the withdrawn aqueous liquid in a bypass stream to the upper portion of the aqueous liquid body, and intermixing the aqueous liquids prior to overflowing to dissolve ice crystals which float on the aqueous liquid body.

4. The method of claim 3 in which in step (f) the bypass stream is sprayed downwardly onto the top of the aqueous liquid body.

5. The method of claim 1 in which said overflowing aqueous liquid flows through a screen prior to passing into said channel, said screen being of a size to restrain ice crystals floating on the aqueous liquid body.

6. The method of claim 1 in which the aqueous liquid flowing in the stream to be carbonated is at ambient temperature.

7. The method of claim 1 together with the step of g. injecting gaseous carbon dioxide into the stream to be carbonated prior to passage of the same into the aqueous liquid body.

* * * * *